United States Patent [19]

Edwards

[11] 4,069,858

[45] Jan. 24, 1978

[54] MANUFACTURE OF FOUNDRY MOULDS AND CORES

[75] Inventor: Albert Edwards, Peterborough, England

[73] Assignee: Baker Perkins Holdings Limited, England

[21] Appl. No.: 595,232

[22] Filed: July 11, 1975

[30] Foreign Application Priority Data

July 15, 1974 United Kingdom ..... 31325/74

[51] Int. Cl.[2] ..... B22D 17/08; B22D 23/00

[52] U.S. Cl. ..... 164/7; 164/160

[58] Field of Search ..... 164/7, 160, 170, 12, 164/37

[56] References Cited

U.S. PATENT DOCUMENTS

| | | | |
|---|---|---|---|
| 2,588,669 | 3/1952 | Taccone | 164/170 |
| 2,988,789 | 6/1961 | Taccone | 164/170 |
| 3,059,294 | 10/1962 | Dunn et al. | 164/7 |
| 3,181,213 | 5/1965 | Schiable et al. | 164/7 |
| 3,293,703 | 12/1966 | Taccone | 164/160 |
| 3,789,907 | 2/1974 | Nakata et al. | 164/7 |
| 3,955,266 | 5/1976 | Honami et al. | 164/7 |
| 3,960,198 | 6/1976 | Matsuura et al. | 164/7 |

*Primary Examiner*—Leonidas Vlachos
*Attorney, Agent, or Firm*—Learman & McCulloch

[57] ABSTRACT

A method and apparatus for preparing sand-based foundry moulds and cores, particularly of the cold-setting type made from a sand/binder/catalyst mixture. After the introduction of the sand mixture into a mould or core box, sealing means is located over an open end of the box to enclose the mixture within the box, and suction is applied to the box. The sealing means may comprise a flexible diaphragm, which is drawn by the suction against the adjacent upper surface of the mixture to compact the mixture.

6 Claims, 2 Drawing Figures

MANUFACTURE OF FOUNDRY MOULDS AND CORES

This invention relates to the manufacture of foundry moulds and cores, and more particularly concerns the preparation of sand-based moulds and cores, hereafter generally referred to as moulds.

In the manufacture of sand-based moulds, particularly of the cold-set type where sand/binder/catalyst mixture which cures at ambient temperature is used, it is desirable to compact the sand mixture after introduction into a mould box in order to obtain better strength of the mould and truer conformity of the sand mixture to the shape of the mould pattern.

The present invention provides a method of preparing sand-based moulds wherein after the introduction of sand mixture into a mould box sealing means is located over an open end of the mould box to enclose the sand mixture within the box and suction is applied to the box. Preferably, the sand mixture is a cold setting sand/binder/catalyst mixture, and the suction pressure applied to the box is in the range of 15 to 30 inches of mercury.

The invention further provides an apparatus for preparing sand-based moulds which includes sealing means locatable over an open end of a mould box after the introduction of sand mixture to the mould box, the sealing means being adapted thereby to enclose the sand mixture within the box, and means for applying suction to the box.

The sealing means may conveniently comprise a flexible diaphragm. Application of suction to the box will withdraw air from the sand mixture and draw the diaphragm against an adjacent surface of the sand mixture to compact the mixture.

The diaphragm is preferably located in a horizontal plane, over the sand mixture in the box, suction being applied to a lower face of the mould box.

After compaction, the sucrion may be released immediately, or in the case of cold-set sand/binder/catalyst mixtures may be maintained for an extended period, since we have found that reduced pressure will accelerate the setting time of the binder.

After the suction is released, suction may be applied to an enclosed space above the diaphragm to draw the diaphragm away from the adjacent surface of the sand mixture.

The diaphragm is conveniently mounted in a vertically displaceable head defining an enclosed space above the diaphragm, means being provided for applying section to said enclosed space to draw the diaphragm away from the adjacent surface of the sand mixture after suction in the box has been released.

Figure 1:
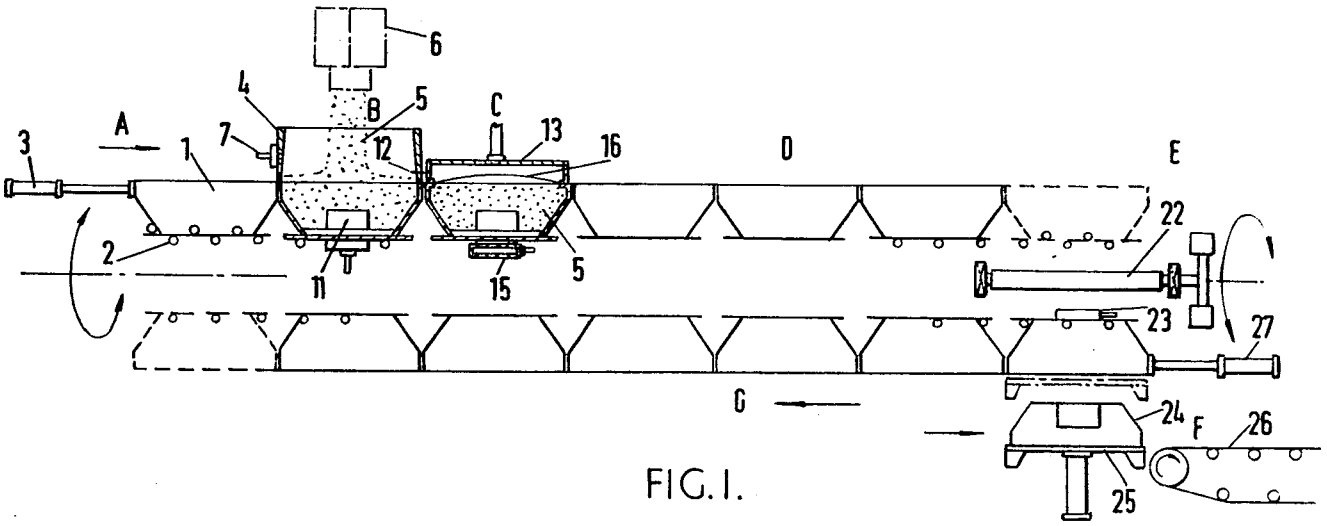
Figure 2:
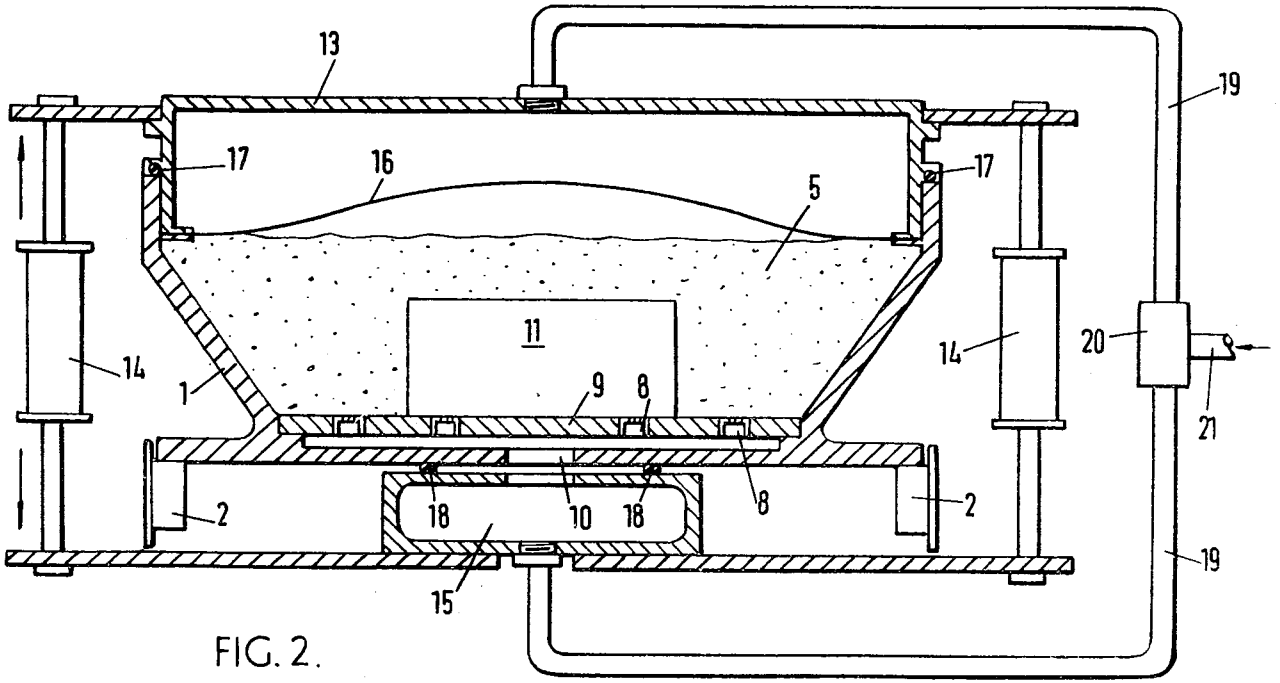

The invention will now be more particularly described by way of example with reference to the accompanying drawings, in which:

FIG. 1 is a diagrammatic side view of a foundry plant incorporating a mould compacting station, FIG. 2 is a diagrammatic side view on a larger scale of a mould compacting station.

In FIG. 1 of the drawings an in-line foundry plant is shown wherein mould or core boxes 1 abutting each other and supported by flanged rollers 2 move along an upper run, and in an inverted orientation and opposite direction along a lower run. The upper run comprises consecutively a roll-over station A, filling station B, compacting station C, curling station D, roll-over station E and discharge station F, the lower run comprising a return line G.

At the roll-over station A, an inverted empty mould or core box 1 is received from the return line G, turned upright by a conventional roll-over device (not shown) and engaged by a pneumatic or hydraulic ram 3 for intermittent feed of boxes to subsequent stations by a chain reaction.

At the filling station B, the mould box 1 is positioned under an upset frame 4 which is lowered to engage the top surface of the box 1. Sand/catalyst/binder mixture 5 is discharged from a mixer 6, as for example described in U.S. patent application Ser. No. 567,890, into the mould box 1 and upset frame 4, the mixture being fluidised by low pressure air, for example at 5 p.s.i.g. from porous or perforated walls of the upset frame 4 fed by an inlet 7, and from vents 8 (FIG. 2) in a pattern plate 9 mounted in the base of the mould box 1 fed by an inlet 10, to give a more uniformed distribution of the sand mixture round a pattern 11. To allow for patterns of different volumes, a probe 12 is mounted in the upset frame 4 slightly above the interface with the mould box 1. When the level of sand mixture 5 reaches the probe 12, feed from the mixer 6 is caused to be stopped.

At the compacting station C, shown on an enlarged scale in FIG. 2, the mould box 1 is positioned under a diaphragm head 13 and the residue of the sand mixture falls from the upset frame 4 into the on-coming mould box. The diaphragm head 13 moves into contact with the mould box 1 by actuation of pneumatic or hydraulically operated piston and cylinder assemblies 14 and simultaneously a vacuum box 15 is raised to engage the base of the mould box 1.

The diaphragm head 13 incorporates a flexible diaphragm 16 adapted to contact the upper surface of the sand mixture 5 and sealing means 17 at the interface with the mould box 1. The vacuum box 15 likewise has sealing means 18 co-operating with the base of the mould box 1.

The diaphragm head 13 and vacuum box 15 are each connected by air lines 19 to a valve 20 providing alternative communication with a vacuum line 21 or with the atmosphere.

The valve 20 is first positioned to open the diaphragm head 13 to the atmosphere and apply a vacuum to the vacuum box 15. Negative pressure or suction is thereby set up in the sand mixture 5 and the diaphragm 16 is drawn against the upper surface of the sand. The sand mixture 5 is thus compacted.

When the compacting operation is completed, the valve 20 is positioned so that a vacuum is applied to the diaphragm head 13 and the vacuum box 15 is opened to the atmosphere. The diaphragm 16 is thereby freed from the upper surface of the sand mixture. Finally, the piston and cyliner assemblies 14 are actuated to separate the vacuum box 15 and diaphragm head 13 from the mould box.

At the curing station D, each mould thus formed is allowed to cure. The length of this station is dependent upon the curing time required.

At the roll-over station E, the mould box 1 is inverted by a roll-over device 22 and a high pressure air box 23 is lowered to engage the base of the mould box 1. The mould 24 is discharged pneumatically at the discharge station F onto a raised table 25 for transfer to take-away conveyor 26 and the high pressure air box 23 is raised from the mould box.

In the same manner as in the upper run, the empty boxes in the lower run are supported by flanged rollers and moved intermittently along the return line G by the action of the ram of a pneumatic or hydraulic cylinder 27 to the roll-over station A for re-cycling.

The diaphragm is preferably made of a material of a non-porous stretchable nature, such as sheet rubber or plastics.

The suction pressure applied to compact the mould is preferbly as great a vacuum as is obtainable under engineering conditions, i.e. about 26 inches of mercury, but satisfactory compacting of the mould may be obtained at a suction pressure of as low as 15 inches of mercury.

Compacting may be further assisted by application of pressure within the range 0 to 50 p.s.i. to the diaphragm head 13 to force the diaphragm 16 against the upper surface of the sand mixture.

Other sealing means may be used to enclose the mixture in the mould box than the diaphragm particularly described above.

I claim:

1. The method of preparing a sand-based mould comprising the steps of introducing a sand mixture into a mould box having an open upper end; sealing said upper end of said box by fitting a flexible diaphragm to said box with one side of said diaphragm overlying and confronting said mixture; and compacting said mixture solely by the application of suction to said box to evacuate the latter sufficiently to draw said diaphragm against said mixture while maintaining the opposite side of said diaphragm in communication with atmosphere.

2. A method as claimed in claim 1 wherein the sand mixture is a cold setting sand/binder/catalyst mixture.

3. A method as claimed in claim 1 wherein the suction pressure applied to the box is in the range 15 to 30 inches of mercury.

4. Apparatus for preparing sand-based moulds comprising a mould box adapted to receive and contain a moulding sand mixture and having an open upper end and means defining vent openings in the lower end of said box, a diaphragm head movable into sealing engagement with the upper end of said box, a flexible diaphragm defining the lower side of said diaphragm head and adapted when said head is in sealing engagement with said box to have its lower side lie against the upper surface of a moulding sand mixture contained in said box, vacuum head means sealingly engageable with the lower end of said mould box and operable when so engaged to apply suction to said vent openings to draw said diaphragm against the upper surface of said sand mixture, and means communicating with said diaphragm head at a level above that of said diaphragm for venting said diaphragm head to atmosphere during the application of suction to said vent openings.

5. Apparatus as claimed in claim 4 wherein said diaphragm head defines an enclosed space above the diaphragm, and means for applying suction to said enclosed space to draw the diaphragm away from the upper surface of the sand mixture after the application of suction to the vent openings has been concluded.

6. Apparatus as defined in claim 5 wherein said means for applying suction to said enclosed space comprises a vacuum source, conduit means connecting said vacuum source to said enclosed space and to said vacuum head means, and valve means in said conduit means for selectively connecting said vacuum source to said enclosed space or to said vacuum head means.

* * * * *

UNITED STATES PATENT AND TRADEMARK OFFICE

CERTIFICATE OF CORRECTION

PATENT NO. : 4,069,858

DATED : January 24, 1978

INVENTOR(S) : Albert Edwards

It is certified that error appears in the above-identified patent and that said Letters Patent are hereby corrected as shown below:

Column 1, line 39, change "sucrion" to --suction--

Column 1, line 51, change "section" to --suction--

Column 1, line 67, change "curling" to --curing--

Column 2, line 55, change "cyliner" to --cylinder--

Signed and Sealed this

*Thirtieth* Day of *May 1978*

[SEAL]

*Attest:*

RUTH C. MASON
*Attesting Officer*

LUTRELLE F. PARKER
*Acting Commissioner of Patents and Trademarks*